US009455525B2

(12) United States Patent
Uno et al.

(10) Patent No.: US 9,455,525 B2
(45) Date of Patent: Sep. 27, 2016

(54) CONNECTOR WITH FLEXIBLE CONDUCTIVE MEMBER TO ISOLATE TERMINAL FROM VIBRATIONS IN A WIRE

(71) Applicants: AUTONETWORKS TECHNOLOGIES, LTD., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Masafumi Uno, Yokkaichi (JP); Yoshitomo Tsujii, Yokkaichi (JP); Katsuhiko Aizawa, Yokkaichi (JP); Kensaku Takata, Yokkaichi (JP); Hiroyuki Matsuoka, Yokkaichi (JP); Tomokazu Kashiwada, Yokkaichi (JP); Kiyotaka Itsuki, Yokkaichi (JP)

(73) Assignees: Autonetworks Technologies, LTD., Yokkaichi (JP); Sumitomo Electric Industries, Ltd., Osaka (JP); Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 13/903,040

(22) Filed: May 28, 2013

(65) Prior Publication Data

US 2013/0316573 A1 Nov. 28, 2013

(30) Foreign Application Priority Data

May 28, 2012 (JP) ..... 2012-120421
Jul. 4, 2012 (JP) ..... 2012-150662

(51) Int. Cl.

| | |
|---|---|
| ***H01R 13/533*** | (2006.01) |
| ***H01R 11/11*** | (2006.01) |
| ***H01R 13/60*** | (2006.01) |
| ***H01R 11/12*** | (2006.01) |
| ***H01R 13/631*** | (2006.01) |
| *H01R 9/03* | (2006.01) |
| *H01R 13/6581* | (2011.01) |

(52) U.S. Cl.

CPC ..... *H01R 13/60* (2013.01); *H01R 11/12* (2013.01); *H01R 13/533* (2013.01); *H01R 13/6315* (2013.01); *H01R 9/03* (2013.01); *H01R 13/6581* (2013.01)

(58) Field of Classification Search

CPC H01R 13/631; H01R 11/12; H01R 13/6581; H01R 9/03; H01R 13/533

USPC ..... 439/359, 587, 660, 1, 2, 9, 586, 606, 439/573, 576, 97, 551, 807, 382–384, 466, 439/468, 582, 881

See application file for complete search history.

(56) References Cited

U.S. PATENT DOCUMENTS 5,064,388 A * 11/1991 Paladel ..... 439/607.23
5,348,497 A 9/1994 Nitescu (Continued)

FOREIGN PATENT DOCUMENTS

JP 2000-277217 10/2000

*Primary Examiner* — Felix O Figueroa
*Assistant Examiner* — Paul Baillargeon
(74) *Attorney, Agent, or Firm* — Gerald E. Hespos; Michael J. Porco; Matthew T. Hespos

(57) ABSTRACT

A connector (10) to be mounted on end portions of wires (16) includes first terminals (19) connected to the end portions of the wires (16), second terminals (23) electrically connected to the first terminals (19) via flexible conductive members (29) and connected to terminals of a mating connector (CN), and a housing (33) for accommodating the first terminals (19) and the second terminals (23).

6 Claims, 12 Drawing Sheets

(56) References Cited

U.S. PATENT DOCUMENTS

| | | | | |
|---|---|---|---|---|
| 7,828,591 | B2 * | 11/2010 | Matsuoka | H01R 4/183 439/559 |
| 2009/0137153 | A1 * | 5/2009 | Yoshioka et al. | 439/607.24 |
| 2011/0316372 | A1 | 12/2011 | Kobayashi et al. | |
| 2012/0015546 | A1 | 1/2012 | Yamaguchi et al. | |
| 2012/0040553 | A1 | 2/2012 | Tashiro | |
| 2012/0231676 | A1 | 9/2012 | Picaud et al. | |

* cited by examiner

CONNECTOR WITH FLEXIBLE CONDUCTIVE MEMBER TO ISOLATE TERMINAL FROM VIBRATIONS IN A WIRE

BACKGROUND OF THE INVENTION

1. Field of the Invention

The present invention relates to a connector.

2. Description of the Related Art

Japanese Unexamined Patent Publication No. 2000-277217 discloses a connector that is intended to prevent a problem in connecting connectors due to a dimensional accuracy error or the like. This connector is configured so that a connector main body pivots according to the position of a mating connector by the deflection of a leaf spring of a spring washer arranged between the connector main body and a bottom plate when the mating connector is inserted.

The connector of Japanese Unexamined Patent Publication No. 2000-277217 has a connector main body and a wire is mounted in the connector main body. If the wire vibrates, the connector main body in which the wire is mounted vibrates, and the vibration may cause a problem with the connection to the mating connector.

The present invention was completed in view of the above situation and an object thereof is to prevent a problem with connection to a mating connector due to the vibration of a wire or the like.

SUMMARY OF THE INVENTION

The invention relates to a connector mountable on a wire. The connector has at least one first terminal connected to the wire, at least one second terminal electrically connected to the first terminal via a flexible conductive member and to be connected to a terminal of a mating connector and a housing for accommodating the first and second terminals.

According to this configuration, influences due to the vibration of the wire and the like can be absorbed by the flexible conductive member connecting the first terminal and the second terminal. The flexible conductive member effectively prevents vibrations of the first terminal from affecting the connection of the second terminal to the terminal of the mating connector.

The flexible conductive member also can prevent abrasion by expanding and contracting like a suspension when contact points of the first and second terminals slide against each other to be abraded due to a difference in linear expansion coefficient between resin and metal. Further, if it is tried to forcibly connect the first and second terminals when the second terminal is twisted with respect to a proper posture, the first terminal may be held in contact with the second terminal only on one side without being able to follow the twisted posture of the second terminal. Also in such a case, the flexible conductive member absorbs the torsion of the second terminal to allow the first and second terminals to be held in contact over a predetermined area, whereby a contact area between the contact points of the first and second terminals can be ensured.

One end of the flexible conductive member preferably is connected to the second terminal, and an intermediate terminal may be connected to the other end of the flexible conductive member. Furthermore, the first terminal and the intermediate terminal preferably are fixed to the housing. Thus, influences due to vibration and the like in parts fixed to the housing and can be cut off and more reliably prevent the occurrence of a problem with connection to the mating connector due to vibration of the wire and the like.

The first terminal and the intermediate terminal may be formed with screw holes and fixed to the housing by inserting a common screw through the screw holes and screwing the common screw into the housing. This can simplify the configuration, for example, as compared with the case where the first terminal and the intermediate terminal are individually screwed to the housing.

The housing preferably is covered at least partly by a shield shell, and the shield shell is fixed to a case of a device. Further particularly, the shield shell preferably is screwed and fixed to the housing to fix the position of the housing via the shield shell.

The shield shell preferably includes a first shell for at least partly covering a predetermined range of the housing and a second shell for at least partly covering a part of the housing not covered by the first shell. Further, the first and second shells each may be formed with a screw hole and fixed to the housing by inserting a common screw through the respective screw holes. This can simplify the configuration as compared with the case where the first and second shells are individually screwed to the housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
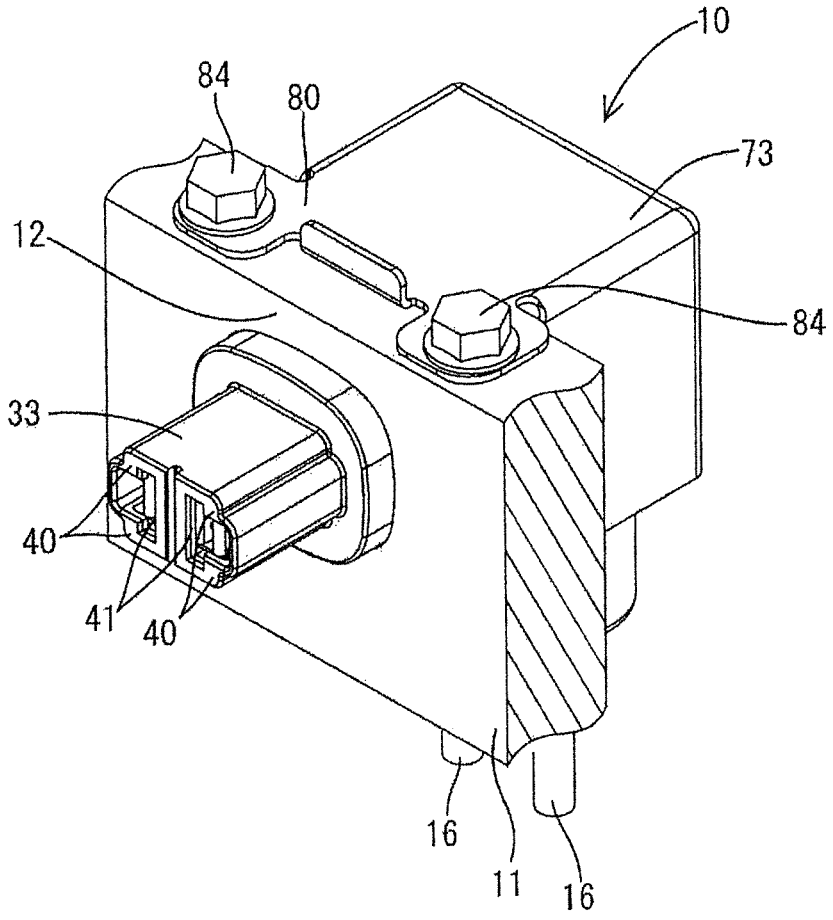
FIG. 1 is a perspective view showing a state where a connector according to one embodiment is mounted to a mounting portion.
Figure 2:
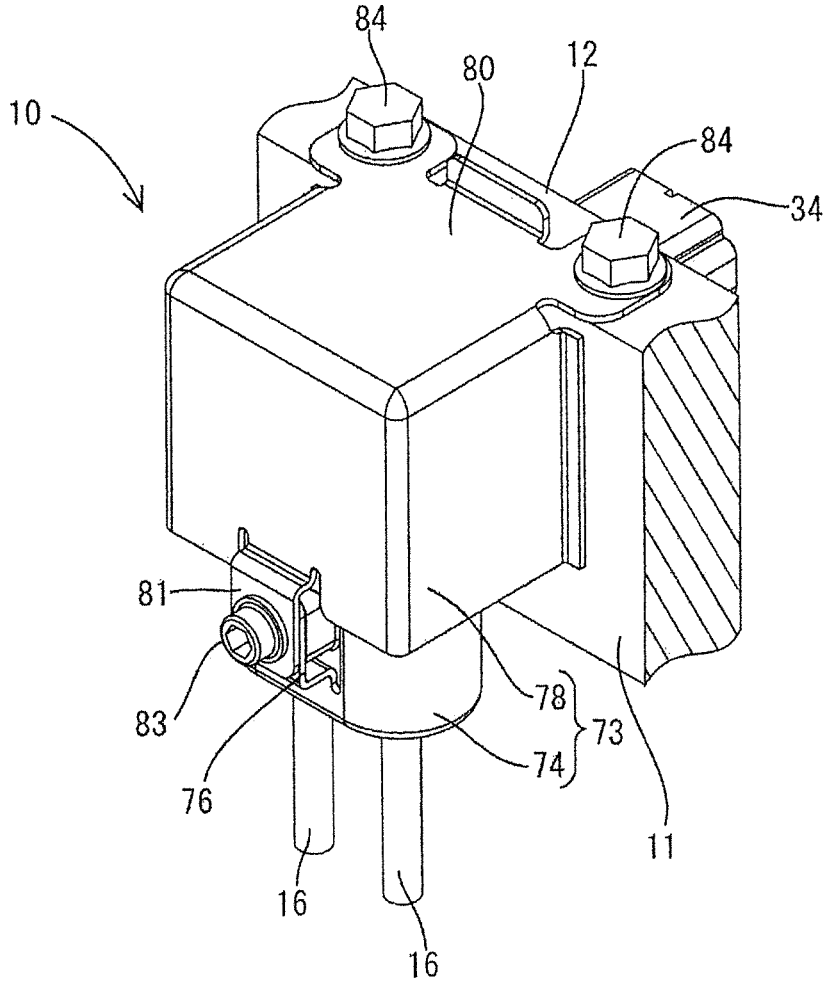
FIG. 2 is a perspective view showing the state where the connector is mounted to the mounting portion when viewed from behind.
Figure 3:
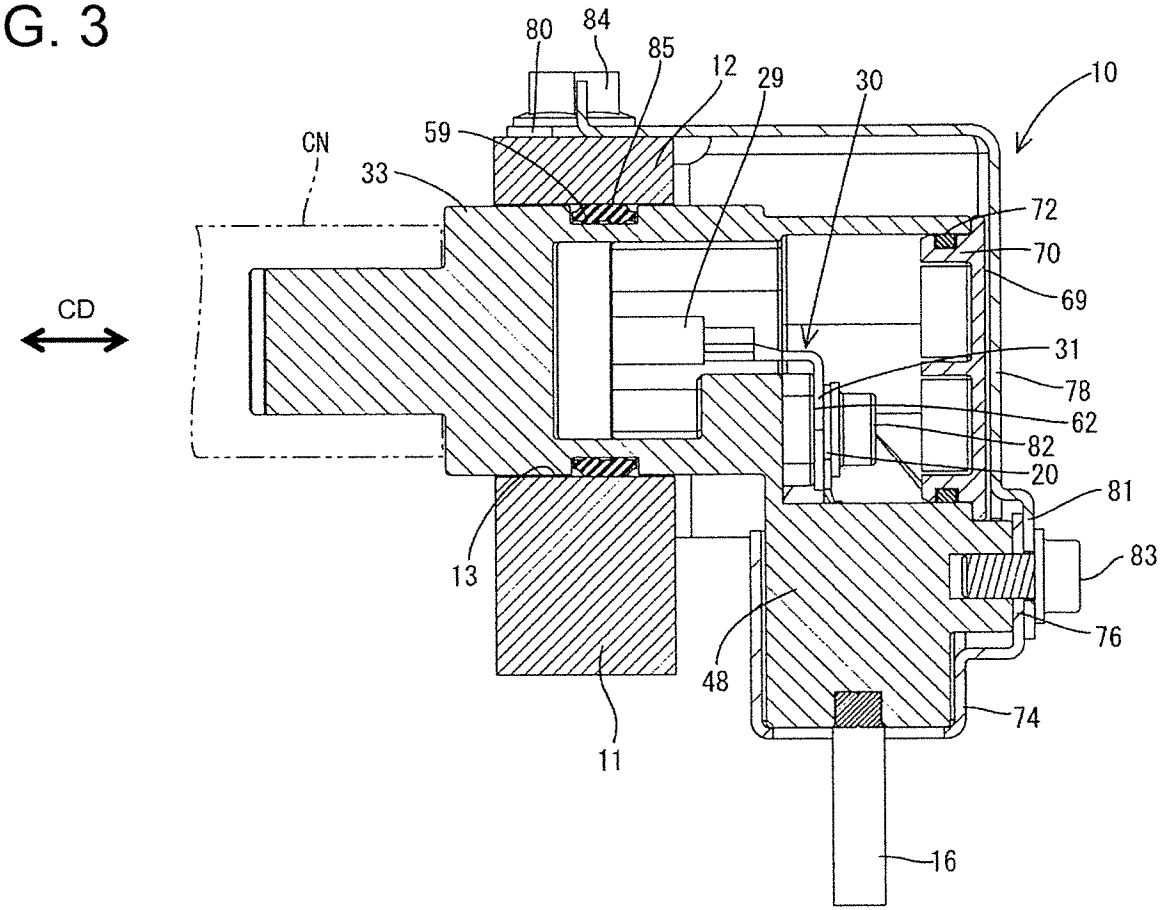
FIG. 3 is a section showing the state where the connector is mounted to the mounting portion.

A connector in accordance with the invention is identified by the numeral 10 in FIGS. 1 to 12. The connector 10 is to be mounted to a shield case 11 of a device (e.g. an inverter, a motor or the like of a vehicle such as a hybrid vehicle or an electric vehicle). In the following description, a vertical direction is based on FIG. 3 and left side (connecting direction CD to a mating connector) and right side of FIG. 3 are respectively referred to as front side and rear side.

The device has a device main body (not shown) to be housed in the shield case 11 made of an electrically conductive material. The left side of the shield case 11 in FIG. 3 is an inner side of the shield case 11. The shield case 11 includes a mounting portion 12 to which the connector 10 is to be mounted. Note that only a part of the shield case 11 of the device is shown and other parts are not shown.

Figure 4:
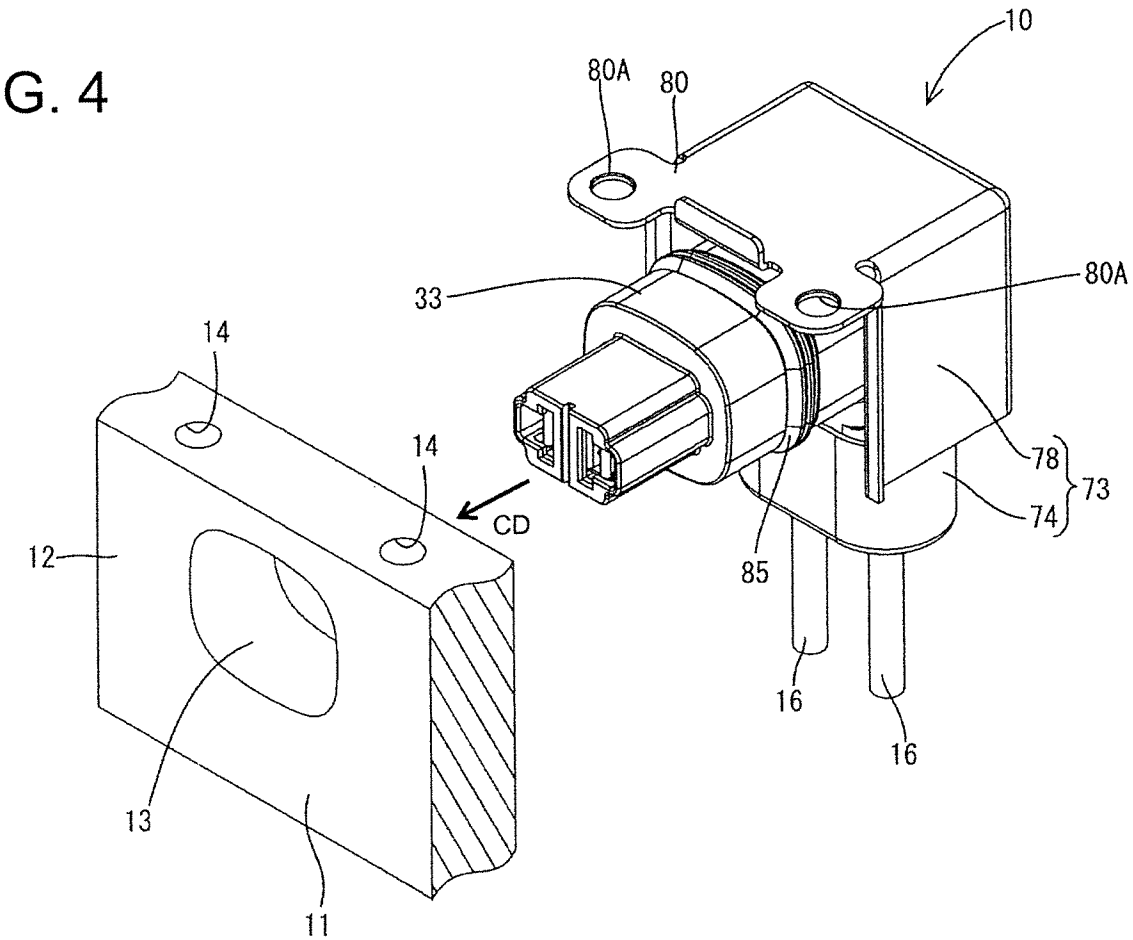
FIG. 4 is a perspective view showing the mounting portion and the connector.
Figure 5:
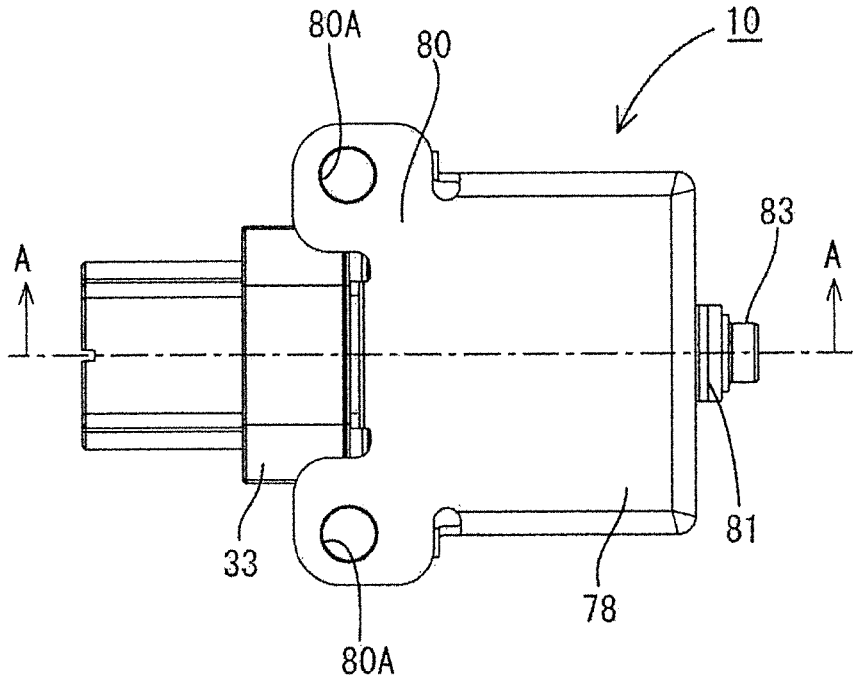
FIG. 5 is a plan view showing the connector.
Figure 6:
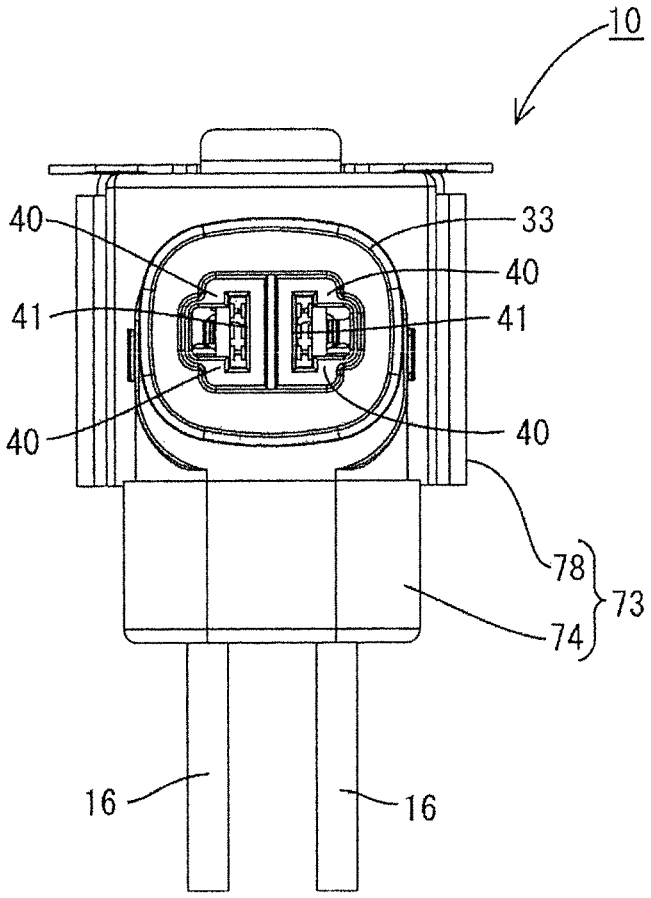
FIG. 6 is a front view showing the connector.
Figure 7:
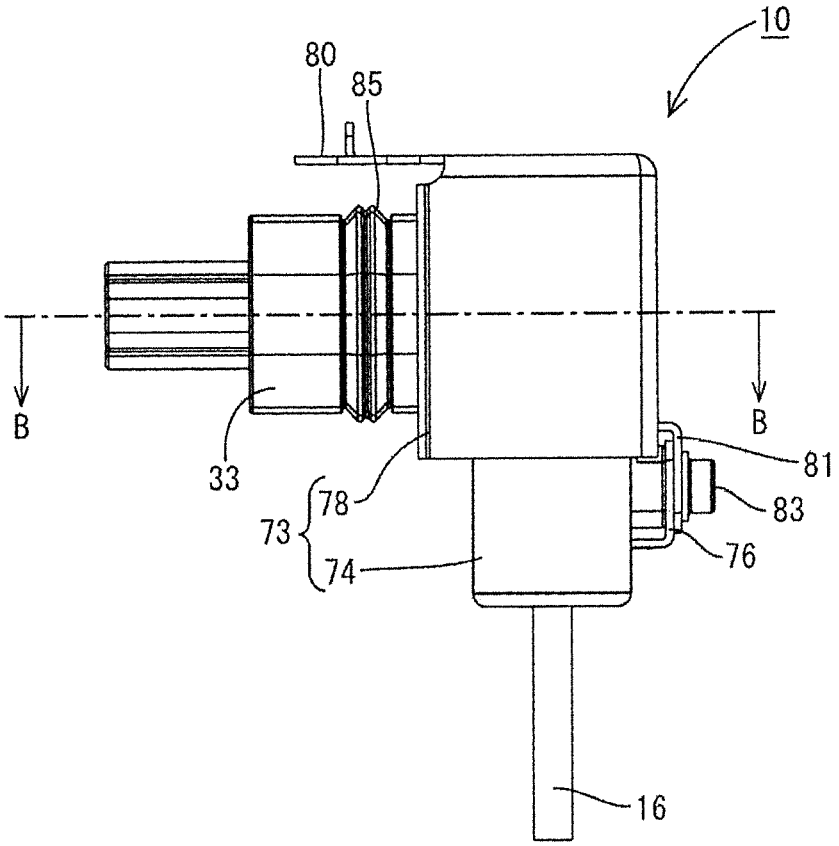
FIG. 7 is a side view showing the connector.
Figure 8:
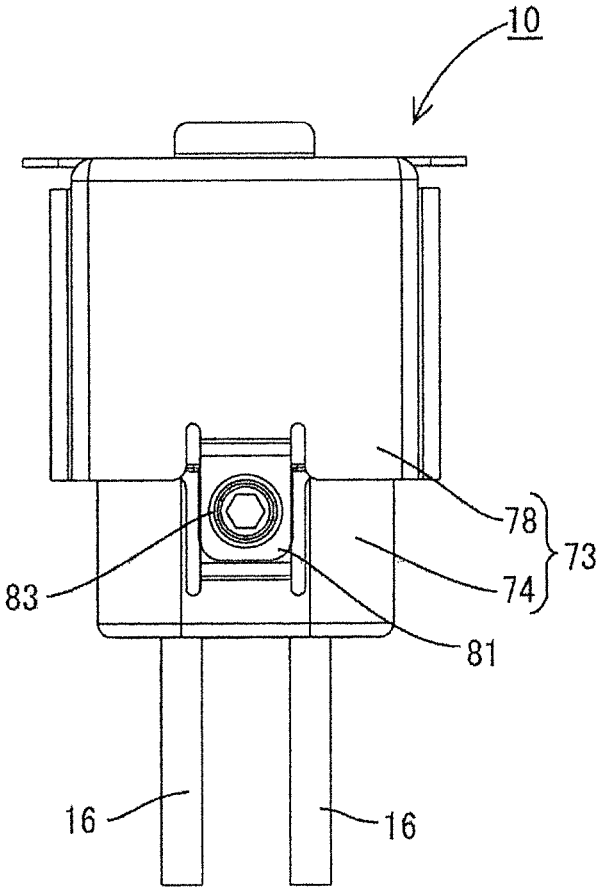
FIG. 8 is a rear view showing the connector.
Figure 9:
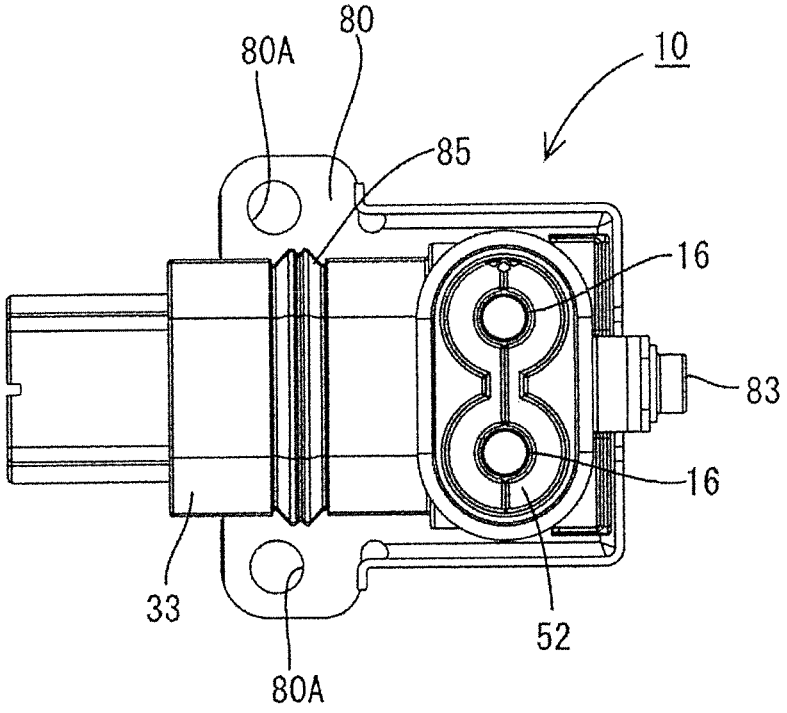
FIG. 9 is a bottom view showing the connector.

As shown in FIG. 4, the mounting portion 12 includes a wide substantially elliptical through hole 13 and left and right internally threaded mounting holes 14 in the upper end of the shield case 11. The connector 10 is to be fixed to the mounting portion 12 by inserting and screwing shafts of male mounting screws 84 into respective mounting holes 80A, 14 with the mounting holes 80A of the connector 10 substantially placed on the mounting holes 14.

A mating connector CN (see FIG. 3) is arranged at a position substantially facing the connector 10 inside the shield case 11.

Figure 12:
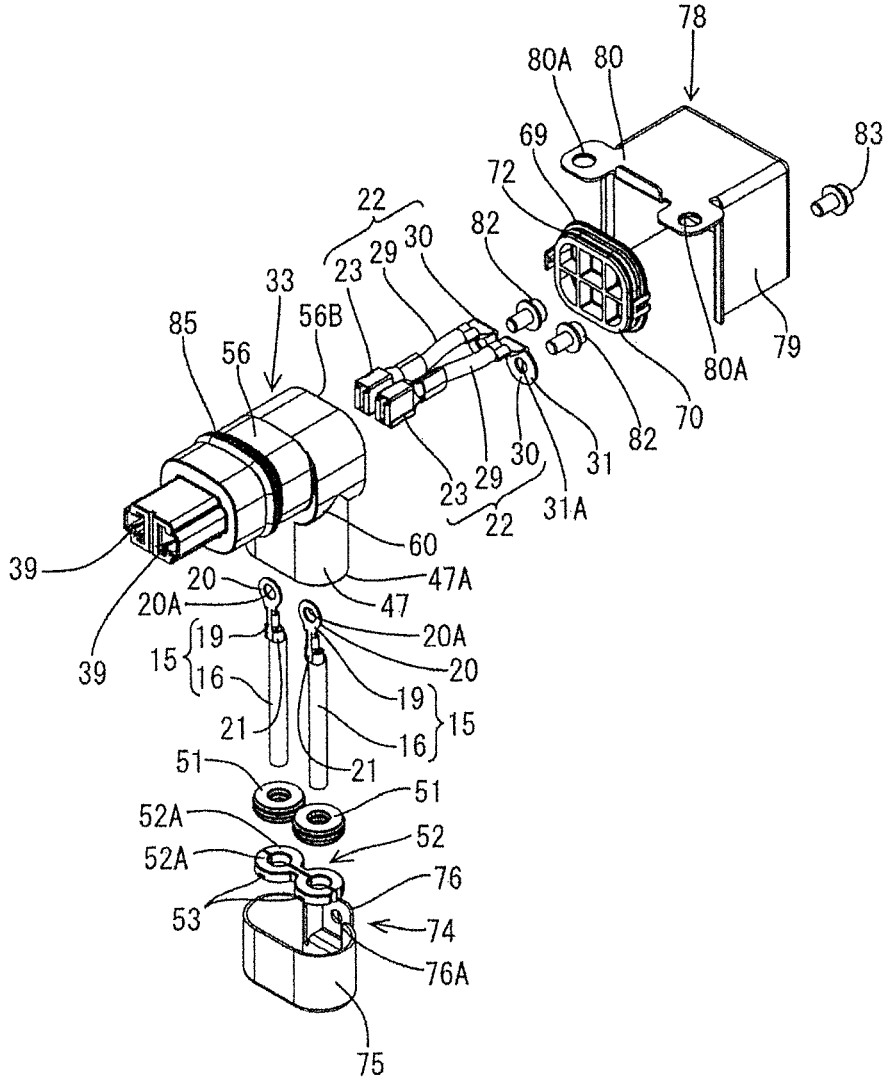
FIG. 12 is an exploded perspective view of the connector.

As shown in FIG. 12, the connector 10 includes terminal-mounted wires 15 each having a first terminal 19 connected to an end portion of a wire 16, a connecting member 22 to be connected to the first terminals 19 and terminals (not shown) of the mating connector CN, a housing 33 for housing the first terminals 19 and the connecting member 22 and a shield shell 73 for at least partly covering the housing 33.

The terminal-mounted wire 15 includes the wire 16 and the first terminal 19 mounted on the end of the wire 16.

The wire 16 has a conductor made of thin metal wires covered by an insulation coating. The insulation coating is stripped to expose the conductor at the end of the wire 16.

The first terminal 19 is a round terminal with a substantially ring-shaped fixing portion 20 to be fixed to the housing 33 and a wire connecting portion 21 unitary with the fixing portion 20 and configured to be connected to the conductor of the wire 16.

A screw hole 20A penetrates through the fixing portion 20.

The wire connecting portion 21 includes a wire barrel with two crimping pieces to be crimped and connected to the conductor exposed at the end portion of the wire 16 and an insulation barrel with two crimping pieces to be crimped and connected to a part of the insulation coating of the wire 16. Note that the connection of the wire 16 and the first terminal 19 is not limited to crimp connection, but various known connection methods such as welding, soldering, insulation displacement or the like can be adopted.

The connecting member 22 includes two second terminals 23 to be connected to the terminals of the mating connector CN, two flexible conductive members 29 having first ends connected to two intermediate terminals 30 and second ends connected to the second terminals 23.

Figure 11:
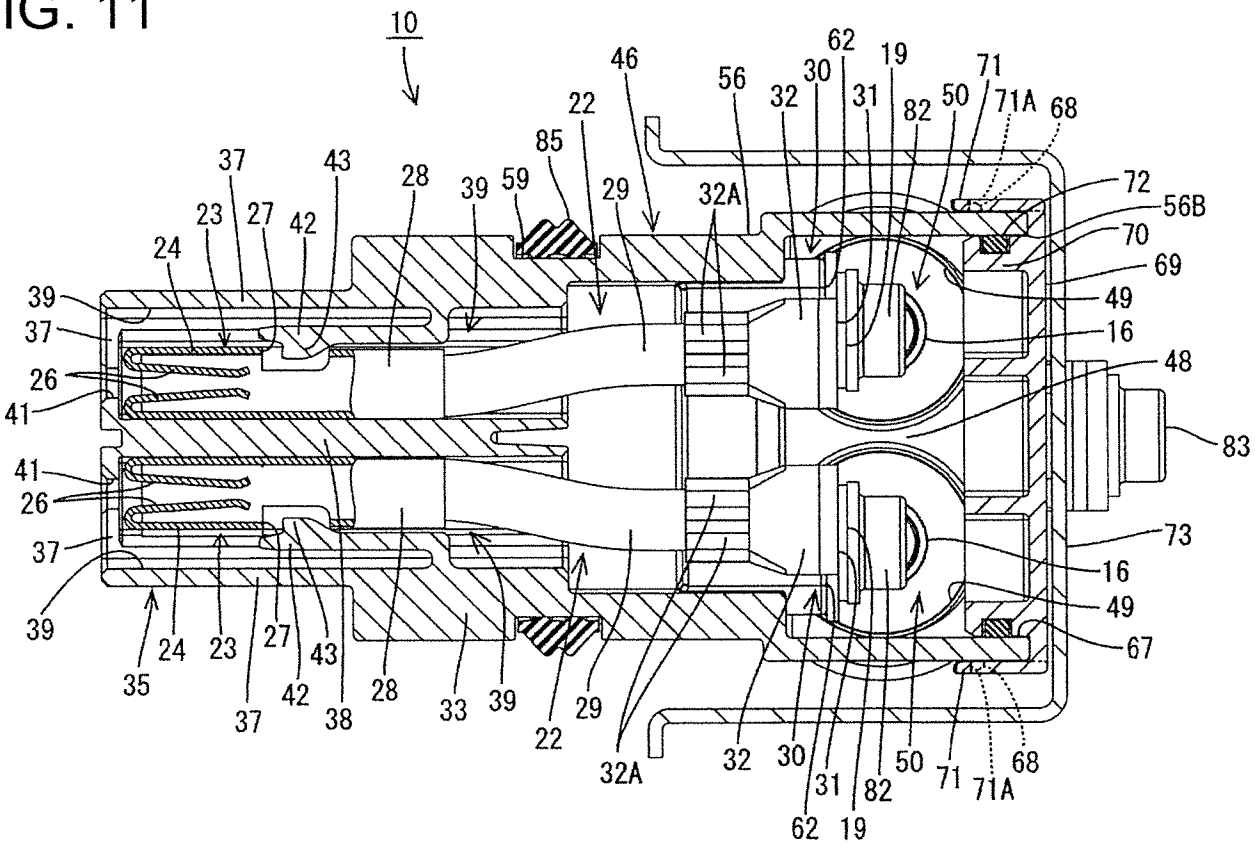
FIG. 11 is a section along B-B of FIG. 7.

As shown in FIG. 11, the second terminal 23 includes a terminal connecting portion 24 to be connected to the terminal of the mating connector CN and a link 28 unitarily connected to the terminal connecting portion 24 and connectable to the second end of the flexible conductive member 29.

The terminal connecting portion 24 includes two resilient contact pieces 26 inside a rectangular tube. The resilient contact pieces 26 are folded back at the leading end of the tube to extend backward.

The tube is cut or recessed to form a lance locking portion 27 with which a locking lance 42 is engageable.

The link 28 is a closed barrel that at least partly surrounds the second end of the flexible conductive member 29, and is crimped and squeezed from an outer side to fix the flexible conductive member 29 while the second end of the flexible conductive member 29 is inserted inside.

The flexible conductive member 29 comprises a flexible conductor and a braided wire that may be formed by braiding thin metal wires of aluminum or aluminum alloy into a mesh. It is also possible to use thin metal wires of copper or copper alloy or other flexible metals besides aluminum or other flexible conductive members, such as a twisted wire and/or a copper foil besides the braided wire.

The intermediate terminal 30 is a substantially round terminal and includes a fixing portion 31 and a link 32. The fixing portion 31 is to be connected to the first terminal 19 and fixed to the housing 33. The link 32 is connected at an angle to the fixing portion 31 and includes two crimping pieces 32A to be crimped and connected to the first end of the flexible conductive member 29.

A base end of the fixing portion 31 is bent to extend substantially perpendicular to an extending direction of the link 32 and a screw hole 31A penetrates through the fixing portion 31 for receiving a shaft of a screw 82.

The screw 82 is a male screw (bolt) with a hexagonal head and a threaded shaft that is to be screwed into a fastening portion 62 of the housing 33 through the respective screw holes 20A, 31A of the first terminal 19 and the intermediate terminal 30.

The flexible conductive member 29 is crimped and connected to the second terminal 23 and the intermediate terminal 30 in this embodiment. However, the flexible conductive member 29 may be connected to the second terminal 23 and the intermediate terminal 30 by various known connection means such as brazing, soldering or welding.

As shown in FIG. 12, the housing 33 has an L-shape and includes a first tube 47 in which the first terminals 19 are to be accommodated, a second tube 56 that substantially extends substantially perpendicular to the first tube 47 and in which the connecting member 22 is to be accommodated, and a coupling 60 that couples the first and second tubes 47, 56.

As shown in FIG. 11, the first tube 47 includes left and right first terminal accommodating chambers 49.

A cavity 50 of a substantially circular cross-section penetrates each first terminal accommodating chamber 49 in the vertical direction, and a partition wall 48 partitions the first terminal accommodating chambers 49 at a laterally central part.

As shown in FIG. 12, a resilient member, such as a rubber ring 51, is arranged on the inner peripheral surface of each first terminal accommodating chamber 49 and is to be held in close contact with the outer periphery of the wire 16.

A retainer 52 is mounted below the rubber ring 51 to prevent displacement of the rubber ring 51. The retainer 52 is formed by fitting a plurality of divided members 52A, 52A. Retaining portions 53 project on the outer periphery of the retainer 52 engage the inner wall of the respective first terminal accommodating chambers 49 for retaining the rubber rings 51.

Figure 10:
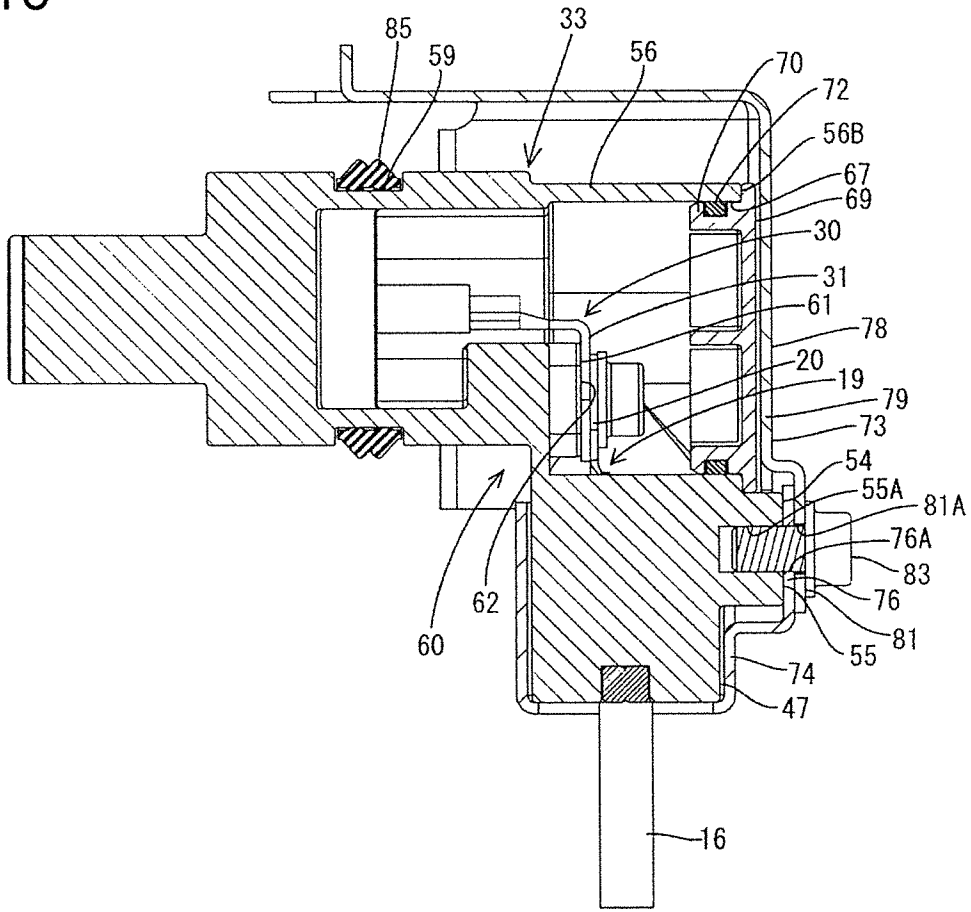
FIG. 10 is a section along A-A of FIG. 5.

As shown in FIG. 10, a shell fixing portion 54 is provided on the rear surface of the first tube 47 for fixing the shield shell 73. The shell fixing portion 54 has a substantially flat surface on which fastening pieces 76, 81 of the shield shell 73 can be placed and is formed with a fastening portion 55 including a screw hole 55A at the position of screw holes 76A, 81A of the shield shell 73.

As shown in FIG. 11, the second tube 56 includes an accommodating portion 35 for accommodating the second terminals 23. The accommodating portion 35 has a wide substantially elliptical outer periphery and a cross-sectionally smaller front is connected to a rear end via at least one step and projects forward.

Left and right second terminal accommodating chambers 37 are formed inside the accommodating portion 35 and are partitioned by a partition wall 38 at a substantially a central part. A cavity 39 penetrates through each second terminal accommodating chamber 37 in forward and backward directions.

A front stop wall 40 projects from the inner wall of the cavity 39 to restrict a forward movement of the second terminal 23. Terminal insertion holes 41 penetrate through the front stop wall 40 at the front end of the cavity 39 and are configured to receive vertically aligned plates of the male terminals of the mating connector CN.

The locking lance 42 cantilevers forward from the inner wall of the cavity 39. A locking projection 43 is provided on the locking lance 42 for engaging the lance locking portion 27 of the second terminal 23.

The second tube 56 includes an opening 56B on the rear end and the outer periphery thereof is recessed annularly to form a mounting groove 59 for receiving a seal ring 85.

As shown in FIG. 10, the coupling 60 includes left and right terminal fitting portions 61 for fixing the first terminal 19 and the intermediate terminal 30 to the housing 33. Each terminal fitting portion 61 has a substantially flat surface for receiving the downwardly bent fixing portion 31 on the intermediate terminal 30, and the fixing portion 20 of the first terminal 19 is placed on the rear side of the fixing portion 31.

The terminal fitting portion 61 is formed with a fastening portion 62 that includes a screw hole at the position of the screw holes 20A, 31A of the first terminal 19 and the intermediate terminal 30 and can be threadably engaged with and fastened to the shaft of the screw 82.

A cover mounting portion 67 is formed on a rear end of the second tube 56 and a protection cover 69 is mountable thereon. As shown in FIG. 11, a cover locking projection 68 is formed on the outer surface of the cover mounting portion 67. The front end of the cover locking projection 68 projects from the outer surface of the second tube 56 to form a step, and a rear side thereof inclines in toward the back.

The protection cover 69 has a wide elliptical shape and is formed with an annular portion 70 on the peripheral edge of a substantially elliptical plate for at least partly closing the opening 56B on the rear end of the second tube 56. The inside of the annular portion 70 is reinforced by a lattice-shaped reinforcement.

A resilient member, such as a rubber ring 72, is mounted on the outer periphery of the annular portion 70.

A locking frame 71 projecting forward is formed unitarily on an outer side of the annular portion 70. The locking frame 71 is formed with a substantially rectangular locking hole 71A on its inner side, and the cover locking projection 68 is to be engaged with the edge of the locking hole 71A.

The shield shell 73 is made of a conductive metal, such as aluminum or aluminum alloy and includes first and second shells 74 and 78. The first shell 74 covers a lower side of the housing 33 and the second shell 78 covers an upper side of the housing 33, as shown in FIG. 12.

The first shell 74 includes a tubular portion 75 with a wide elliptical cross-section and a first fastening piece 76 extends out or up from the rear surface of the tubular portion 75. A substantially round screw hole 76A penetrates a substantially a central part of the first fastening piece 76.

The second shell 78 includes a shielding portion 79 with a recessed shape substantially in conformity with the rear surface shape of the housing 33. A mount portion 80 is formed at the outer or upper surface of the shielding portion 79 and is to be mounted to the mounting portion 12 of the shield case 11. A second fastening piece 81 projects down from the rear end surface of the shielding portion 79. The mount portion 80 is formed with left and right round mounting holes 80A.

As shown in FIG. 10, the second fastening piece 81 is substantially a strip extending down and out from the shielding portion 79 and the substantially round screw hole 81A penetrates therethrough. The second fastening piece 81 is fixed to the housing 33 in a state where the first and second shells 74, 78 are electrically connected by inserting the shaft of the screw 83 through the screw hole 81A and screwing it into the fastening portion 55. Further, since the shield shell 73 is to be fixed to the mounting portion 12 of the shield case 11, the housing 33 is fixed to the shield case 11 and the positions of the first terminals 19 and the intermediate terminals 30 fixed to the housing 33 are also fixed with respect to the shield case 11.

The connector is assembled by initially inserting two wires 16 through the rubber rings 51 and the first shell 74. The first terminals 19 then are crimped and connected to the ends of the respective wires 16 to form the terminal-mounted wires 15.

The second terminals 23 are crimped to the second ends of the flexible conductive members 29 and the intermediate terminals 30 are crimped and connected to the first ends to form the connecting member 22 (see FIG. 12).

The second terminals 23 of the connecting member 22 then are inserted into the respective cavities 39 of the housing 33 and cause the locking lances 42 to deform. However, the locking lances 42 restore and engage the lance locking portions 27 when the second terminals 23 are inserted to proper positions in the cavities 39 so that the second terminals 23 are positioned and retained.

The fixing portions 31 of the intermediate terminals 30 then are placed on the terminal fitting portions 61 of the housing 33. Subsequently, the fixing portions 20 of the first terminals 19 are placed on the fixing portions 31 of the intermediate terminals 30 that had been placed on the terminal fitting portions 61 of the housing 33.

The rubber rings 51 are fit into through openings 47A on the lower end of the first tube 47 and the retainer 52 is mounted on the outer side of the rubber rings 51 to hold the rubber rings 51.

The screws 82 are inserted through the respective screw holes 20A, 31A of the first terminals 19 and the intermediate terminals 30 and screwed into the fastening portions 62 of the housing 33, thereby fixing the first terminals 19 and the intermediate terminals 30 to the housing 33 (see FIG. 11).

The protection cover 69 then is mounted to the cover mounting portion 67, and the locking frame 71 is engaged with the cover locking projection 68 to close the opening 56B of the second tube 56.

The first shell 74, through which the wires 16 already are passed, then is mounted externally on the first tube 47 of the housing 33. The second shell 78 then is mounted to the housing 33 from behind so that the respective fastening pieces 76, 81 overlap each other.

The screw 83 is inserted through the screw holes 76A, 80A of the fastening pieces 76, 81 and screwed into the fastening portion 55 of the housing 33 to fix the shield shell 73 to the housing 33.

The flexible conductive members 29 connect the first and second terminals 19 and 23 and absorb influences of vibration of the wires 16. As a result, the second terminals 23 connected to the terminals of the mating connector CN are unaffected by vibrations from the first terminals 19 and the wires 16. This can prevent problems with connection to the mating connector due to the vibration of the wires 16.

The flexible conductive members 29 also can prevent abrasion by expanding and contracting like a suspension when contact points of the first and second terminals slide against each other and abrade due to a difference in linear expansion coefficient between resin and metal. An attempt could be made to forcibly connect the first and second terminals when the second terminal is twisted with respect to a proper posture. However, the first terminal is held in contact with the second terminal only on one side without following the twisted posture of the second terminal. The flexible conductive member 29 also absorbs torsion of the second terminal to allow the first and second terminals to be held in contact over a predetermined area. Thus, a contact area between the contact points of the first and second terminals 19 and 23 is ensured.

The second end of the flexible conductive member 29 is connected to the second terminal 23, the intermediate terminal 30 is connected to the first end of the flexible conductive member 29 and the first terminal 19, and the intermediate terminal 30 and the first terminal 19 are fixed to the housing 33. Thus, influences due to vibration in parts fixed to the housing 33 are cut off and vibration of the wire 16 will not cause problems with connection to the second terminal 23 even though the first terminal 19 and the intermediate terminal 30 are fixed to the housing 33.

The first terminal 19 and the intermediate terminal 30 have the screw holes 20A, 31A and can be fixed to the housing 33 by inserting the common screw 82 through the screw holes 20A, 31A and screwing the common screw 82 into the housing 33. This can simplify the configuration, for example, as compared with the case where the first terminal 19 and the intermediate terminal 30 are screwed individually to the housing 33.

The housing 33 is covered at least partly by the shield shell 73, and the shield shell 73 is fixed to the shield case 11 of the device and screwed to the housing 33 thereby fixing the position of the housing 33 via the shield shell 73.

The shield shell 73 has the first shell 74 covering a predetermined range of the housing 33 and the second shell 78 covering a part of the housing 33 not covered by the first shell 74. The first and second shells 74 and 78 are formed with the screw holes 76A, 81A and fixed to the housing 33 by inserting the common screw through the screw holes 76A, 81A. This simplifies the configuration as compared with the case where the first shell 74 and the second shell 78 are screwed individually to the housing 33.

The invention is not limited to the above described and illustrated embodiment. For example, the following embodiments also are included in the scope of the invention as defined in the claims.

The first terminals 19 and the intermediate terminals 30 are fixed to the housing 33 by the screws 82 in the above embodiment. However, there is no limitation to this and the first terminals 19 and the intermediate terminals 30 need not be fixed by the screws 82. For example, the first terminals 19 and the intermediate terminals 30 may be fixed within a predetermined range by locking lances or the like. Even if the first terminals 19 and the intermediate terminals 30 are not strictly fixed in this way, the disposition of the flexible conductive members 29 between the first terminals 19 and the second terminals 23 ensure that the second terminals 23 connected to the terminals of the mating connector CN are unaffected by the vibration of the wires 16 and the like.

The shapes of the first terminals 19, the second terminals 23 and the intermediate terminals 30 are not limited to those of the above embodiment and terminals having other known shapes can be used.

The shield shell 73 is composed of the first and second shells 74 and 78. However, the rear of the housing 33 may be covered by a unitary shield shell.

More or fewer than two wires 16 may be provided.

The first terminal 19 and the intermediate terminal 30 are fastened by one screw 82 in the above embodiment. However, the first terminal 19 and the intermediate terminal 30 may be screwed to the housing 33 by different screws. Further, the first shell 74 and the second shell 78 may be screwed to the housing 33 by different screws.

The connector 10 is on an end of a wire mounted to a device-side connector provided in a device, such as an inverter or a motor of a vehicle. However, the connector 10 may be on an end of a wire mounted to a device other than inverters and motors.

The connector 10 is mounted in the shield case 11 in the above embodiment. However, the connector 10 may be mounted in a case having no shielding function.

The screws 82, 83 are screwed directly into the fastening portions 62, 55 of the housing 33 in the above embodiment. However, nuts may be embedded and fixed in the housing and the terminals 19, 30 and the shells 74, 78 may be fixed to the housing 33 by tightening bolts into the nuts fixed in the housing.

What is claimed is:

1. A connector for connecting at least one wire that extends in a first direction to a mating connector in a device, comprising:

an integral housing formed to include a first terminal accommodating chamber fixed at a first position in the housing and aligned in the first direction, a second terminal accommodating chamber fixed at a second position in the housing and aligned in a second direction orthogonal to the first direction, a coupling space fixed at a third position in the housing between the first and second terminal accommodating chambers, and an opening formed through the housing at a location spaced from the second terminal accommodating chamber and communicating with the coupling space at a position aligned with the first terminal accommodating chamber;

a first terminal having a first wire connecting portion crimped to the wire and mounted in the first terminal accommodating chamber, the first terminal further having a fixing portion unitary with the first wire connecting portion and extending into the coupling space of the housing at a position aligned with the opening;

a second terminal mounted in the second terminal accommodating chamber and having a terminal connection portion configured for resilient sliding connection along the second direction to a terminal in the mating connector and a second wire connecting portion;

a flexible conductive member extending substantially in the second direction and comprised of a plurality of thin flexible wires, the flexible conductive member having a first end extending into the coupling space and a second end connected to the second wire connecting portion of the second terminal;

an intermediate terminal having a link connected with the first end of the flexible conductive member and having a fixing portion bent orthogonally to the link and being in contact with in contact with the fixing portion of the first terminal fitting at a position in the coupling space of the housing aligned with the opening; and a screw passing through the fixing portions of the first terminal and the intermediate terminal along the second direction and screwed into the housing in the second direction and at a position so that a head of the screw is aligned with the opening, wherein the flexible conductive member isolates the second terminal from vibrations in the wire in a plurality of different directions.

2. The connector of claim 1, wherein the first terminal and the intermediate terminal each are formed with a screw hole and a screw is inserted through the screw holes and screwed into the housing along the second direction.

3. The connector of claim 1, wherein the flexible conductive member comprises a braided wire.

4. The connector according of claim 1, further comprising a shield shell covering the housing, the shield shell being fixed to a case of a device and being screwed and fixed to the housing.

5. The connector of claim 4, wherein the shield shell includes a first shell for at least partly covering a specified range of the housing and a second shell for at least partly covering a part of the housing not covered by the first shell.

6. The connector of claim 5, wherein the first shell and the second shell are each formed with a screw hole and fixed to the housing by inserting a common screw through the respective screw holes.

* * * * *